US007482039B2

(12) United States Patent
Bacos et al.

(10) Patent No.: US 7,482,039 B2
(45) Date of Patent: Jan. 27, 2009

(54) PROTECTIVE COATING FOR MONOCRYSTALLINE SUPERALLOY

(75) Inventors: Marie-Pierre Bacos, Antony (FR); Pierre Josso, Issy les Moulineaux (FR)

(73) Assignee: ONERA (Office National d'Etudes et de Recherches Aerospatiales), Chatillon (FR)

( * ) Notice: Subject to any disclaimer, the term of this patent is extended or adjusted under 35 U.S.C. 154(b) by 111 days.

(21) Appl. No.: 11/345,807

(22) Filed: Feb. 1, 2006

(65) Prior Publication Data

US 2007/0071991 A1 Mar. 29, 2007

(30) Foreign Application Priority Data

Feb. 1, 2005 (FR) ..... 05 00984

(51) Int. Cl.
*B05D 3/00* (2006.01)
*B05D 3/02* (2006.01)

(52) U.S. Cl. ..... 427/328; 427/327; 427/383.1; 427/383.7; 427/405

(58) Field of Classification Search ..... 427/327, 427/328, 383.1, 383.3, 383.7, 404, 405
See application file for complete search history.

(56) References Cited

U.S. PATENT DOCUMENTS

| | | | | |
|---|---|---|---|---|
| 4,447,503 | A * | 5/1984 | Dardi et al. | 428/632 |
| 5,366,695 | A | 11/1994 | Erickson | |
| 5,482,789 | A | 1/1996 | O'Hara et al. | |
| 5,598,968 | A | 2/1997 | Schaeffer et al. | |
| 5,695,821 | A | 12/1997 | Murphy et al. | |
| 6,080,246 | A | 6/2000 | Wing | |
| 6,444,057 | B1 * | 9/2002 | Darolia et al. | 148/428 |
| 6,447,932 | B1 | 9/2002 | O'Hara et al. | |
| 6,471,790 | B1 | 10/2002 | Fernihough | |
| 6,641,929 | B2 | 11/2003 | Kelly et al. | |
| 2002/0197502 | A1 | 12/2002 | Zhao et al. | |
| 2004/0194858 | A1 | 10/2004 | Bacos et al. | |

FOREIGN PATENT DOCUMENTS

| | | |
|---|---|---|
| CA | 2 276 154 A1 | 1/2000 |
| EP | 0 207 874 A2 | 1/1987 |

OTHER PUBLICATIONS

English Translation of French Patent Application No. 98 08693 (Publication No. 2 780 982) previously submitted Feb. 1, 2006; dated Jan. 14, 2000 in the name of Caron et al.

English Translation of French Patent Application No. 03 04104 (Publication No. 2 853 329) previously submitted Feb. 1, 2006; dated Oct. 8, 2004 in the name of Bacos et al.

V.A. Pavlovskii, "Heat Resistant Coating on High-Temperature Metals" Protection of Metals, vol. 40, No. 4, 2004, pp. 358-361, Translated from Zashchita Metallov, vol. 40, No. 4, 2004, pp. 400-403 XP008051847.

(Continued)

*Primary Examiner*—Michael La Villa
(74) *Attorney, Agent, or Firm*—Christie, Parker & Hale, LLP

(57) ABSTRACT

In order to protect a monocrystalline superalloy rich in rhenium against corrosion whilst avoiding the formation of progressive secondary reaction zones, a layer (3) formed of tungsten and cobalt is deposited on its surface before aluminisation treatment.

19 Claims, 1 Drawing Sheet

OTHER PUBLICATIONS

Warnes, et al., "Cyclic Oxidation of Diffusion Aluminide Coatings on Cobalt Base Super Alloys," in Surface and Coatings Technology 2001, Jun. 2001, pp. 163-170, Elsevier Science B.V., New York, N.Y.
Brenner, "Electrodeposition of Alloys Principles and Practice," 1963, vol. II, Academic Press, New York and London, no month.
Mackay, et al., "Techniques Optimized for Reducing Instabilities in Advanced Nickel-Base Superalloys for Turbine Blades," R&T, 2001 Research and Technology, NASA/TM-2002-211333, pp. 10-12, especially pp. 10 and 11, no month.

* cited by examiner

PROTECTIVE COATING FOR MONOCRYSTALLINE SUPERALLOY

CROSS REFERENCE TO RELATED APPLICATION

This application claims priority of French Patent Application Number 0500984, filed Feb. 1, 2005.

BACKGROUND OF THE INVENTION

The invention relates to a method of protecting against corrosion a monocrystalline superalloy containing at least one refractory metal, in which is formed on the surface of the superalloy a coating containing aluminium.

With the purpose of optimising temperature-resistance and oxidation-resistance of parts of turboengines composed of superalloys, these are covered with a protective coating containing aluminium in order to form at the surface of the part covered a protective aluminium oxide. This coating may be formed by conventional aluminisation treatment, which may be either high-activity or low-activity, e.g. low-activity vapour-phase aluminisation. However, the aluminium present in this coating migrates as much towards the surface of the part where it renews the oxide layer as towards the superalloy substrate, of which it impairs the features of use (the aluminium is then the chemical motor of this impairment) and in so far reduces the amount available to renew the oxide layer.

In order to improve the mechanical properties of turboengine parts composed of nickel-based superalloys, compositions have been developed which are rich in refractory elements and at the limit of stability, the limit of solubility of these elements in they phase being affected.

After the development of a coating on this type of superalloy with a γ/γ' structure, there appear in the layer known as the "diffusion layer" located between the coating and the substrate microstructural weaknesses leading to the formation of phases said to be TCP (Topologically Close Packed) and progressive secondary reaction zones (SRZ). These form in the part of the diffusion layer closest to the substrate, known as the interdiffusion zone.

The affect of the secondary reaction zones on the mechanical properties is still poorly understood. However, the mere fact that a secondary reaction zone, whose thickness may vary from 20 to 100 μm according to the quantity of available aluminium, forms under the diffusion zone, whose thickness is typically of the order of 20 μm, reduces by that amount the thickness of healthy alloy. This may be particularly harmful in the case where a thin-walled component is being used, such as cooled blades. Therefore, numerous work has been carried out to identify the causes of secondary reaction zones and to reduce them, if not eliminate them.

The nature of the substrate and its chemical composition (in particular monocrystalline alloy rich in rhenium and low in cobalt) seem to play a part in determining the appearance of secondary reaction zones.

In the conditions of use of the parts, the secondary reaction zones increase towards the interior thereof, further reducing their mechanical strength over the course of time.

Local stresses also favour the appearance of secondary reaction zones. These local stresses are due to operations prior to any coating (sand-blasting in particular) (mechanical motor).

The analysis of a secondary reaction zone shows that it is formed of filaments γ in a matrix γ'. An incoherent grain boundary separates the secondary reaction zones from the γ/γ' structure of the superalloy.

Some authors have sought to overcome the mechanical motor by reducing the stresses by recrystallising a thin surface zone of the superalloy before proceeding to the stages of forming the coating (Rebecca A MacKay, Ivan E Locci, Anita Garg, Frank J Ritzert, Techniques Optimized for Reducing Instabilities in Advanced Nickel-base Superalloys for Turbine blades, RT2001 NASA Technology report, NASA TM 2002-211333; W H Murphy, W S Walston, Method for making a coated Ni base superalloy article of improved microstructural stability, U.S. Pat. No. 5,695,821).

Others specify changes in composition (U.S. Pat. No. 5,695,821; K S O'Hara, W S Walston, E W Ross, R Darolia, Nickel base superalloy and article, U.S. Pat. No. 5,482,789) or carbiding treatments (J Fernihough, Process for strengthening the grain boundaries of a component made from a Ni based superalloy, U.S. Pat. No. 6,471,790; J Schaeffer, A K Bartz, P J Fink, Method for preventing recrystallisation after cold working superalloy article, U.S. Pat. No. 5,598,968), or of nitriding (K S O'Hara, W S Walston, J C Schaeffer, Substrate stabilisation of superalloy protected by an aluminium-rich coating, U.S. Pat. No. 6,447,932). These latter specifications have the aim of creating carbides or nitrides which would pin down the secondary reaction zones and would inhibit their progression.

Kelly et al. (T J Kelly, P K Wright III, Article having a superalloy protective coating and its fabrication, U.S. Pat. No. 6,641,929) propose to deposit a metal layer by cathode sputtering before the protective operation. This layer is no other than a second superalloy, the γ/γ' alloy interdiffusion not leading to the formation of secondary reaction zones.

Finally, R G Wing teaches (Method of aluminizing a superalloy, U.S. Pat. No. 6,080,246) that it is possible to stabilise the composition of the surface of superalloys heavily enriched in refractory elements (Re and/or Ru) by the diffusion of a deposit of cobalt or a deposit of chromium, the latter being preferably deposited by thermochemical means (chromising). However, in the case where cobalt is used, although this technique makes it possible to do away with secondary reaction zones, it leads to the formation of a protective coating heavily enriched in this element. In an article by Warnes et al. (Cyclic oxidation of diffusion aluminide coatings on cobalt base super alloys, Bruce M Warnes, Nick S DuShane, Jack E Cockerill, Surface and Coatings Technology 148 (2001) 163-170), it is stated in conclusion that the coatings obtained by diffusion on cobalt-based alloys (the aluminides of cobalt) are probably insufficient to protect the turbines in operation. This technique therefore makes it possible to retain the microstructure of the alloy but to the detriment of its resistance to oxidation.

SUMMARY OF THE INVENTION

In order to alleviate all these disadvantages, an original route has been taken which, whilst respecting the microstructure of superalloys rich in refractory elements, makes it possible to obtain, by diffusion, a coating which is effective against corrosion and oxidation at high temperature.

In fact, when a coating is being created by diffusion, it is well-known by the person skilled in the art that an interdiffusion layer forms between the coating and the substrate. This interdiffusion layer can be likened to a diffusion barrier, since when nickel is being diffused towards the coating being constructed, all the gamma-generating elements soluble in the gamma phase precipitate at this interface, thus forming the TCP phases and slowing the diffusion of aluminium towards the substrate. However, in the case of alloys rich in refractory elements, the loss of nickel from the γ phase, apart from the precipitation of insoluble elements in the γ' phase, leads to the appearance of secondary reaction zones with inversion of the structure dispersed phase/matrix from γ/γ' to γ'/γ). Moreover, the low steric bulk of the TCP phases does not much slow down the diffusion of aluminium from the coating to the substrate, which allows the secondary reactions zones created during diffusion of the nickel to the coating to increase (chemical motor).

A close study of the tungsten-rhenium binary equilibrium diagram shows that the latter element is soluble in tungsten up to a concentration of 30% by mass. Beyond this limit, a new phase forms (the phase σ) which accepts up to 65% by mass rhenium. If, therefore, a virtually continuous layer of tungsten is deposited on the surface of the superalloy, it will serve to capture the rhenium and other gamma-generating elements, such as chromium, thus forming a virtually continuous layer of TCP phase which will prevent the diffusion of nickel towards the coating under construction and the diffusion of aluminium towards the substrate.

The invention aims in particular at a method of the type defined in the introduction, and provides that before forming the coating, one deposits on the surface a layer containing tungsten, in particular a layer consisting of tungsten and cobalt.

Optional, additional or alternative features of the invention are given below:

- The superalloy has a base of nickel, cobalt and/or iron.
- The superalloy contains at least one refractory metal selected from rhenium and ruthenium.
- The superalloy has a matrix of phase γ in which are dispersed hardening particles of phase γ', at least one refractory metal being contained in the phase γ at a concentration close to its limit of solubility.
- The tungsten and cobalt contained in the layer are deposited concomitantly by electrolytic means.
- The layer contains about 35 to 80% by mass cobalt and 65 to 20% by mass tungsten.
- The thickness of the layer is between about 5 and 25 μm and is preferably between about 10 and 20 μm.
- The coating containing aluminium is formed by an aluminisation treatment.
- The coating further contains at least one element selected from zirconium and hafnium.
- Before the aluminisation treatment, on the tungsten-containing layer a layer containing at least one element selected from platinum and palladium is deposited.
- The layer containing platinum and/or palladium has a thickness of between about 5 and 15 μm.
- An electrolytic pre-deposition of nickel is carried out before the deposition of tungsten.
- The said pre-deposition has a thickness of between about 0.1 and 0.2 μm.
- An electrolytic post-deposition of nickel is carried out after the deposition of tungsten and before the deposition of aluminium and if necessary before the deposition of platinum and/or palladium.
- The said post-deposition has a thickness of between about 5 and 25 μm and preferably between about 5 and 15 μm.
- The deposition of the layer containing tungsten and/or if necessary the pre-deposition and/or the post-deposition are followed by annealing.

The further subject of the invention is a metal part such as can be obtained by the method defined above, comprising a substrate formed of a superalloy equipped with a coating comprising four superimposed layers, in particular:

a) an interdiffusion zone containing TCP (Topologically Close Packed) phases rich in elements which are insoluble or not very soluble in the phase β-NiAl;

b) a diffusion barrier formed mainly of tungsten and of at least one other refractory metal contained in the superalloy, in particular rhenium;

c) a transition zone containing Ni and Al at progressively increasing concentrations; and d) a surface layer formed mainly of β-NiAl.

DETAILED DESCRIPTION OF PREFERRED EMBODIMENTS

Figure 1:
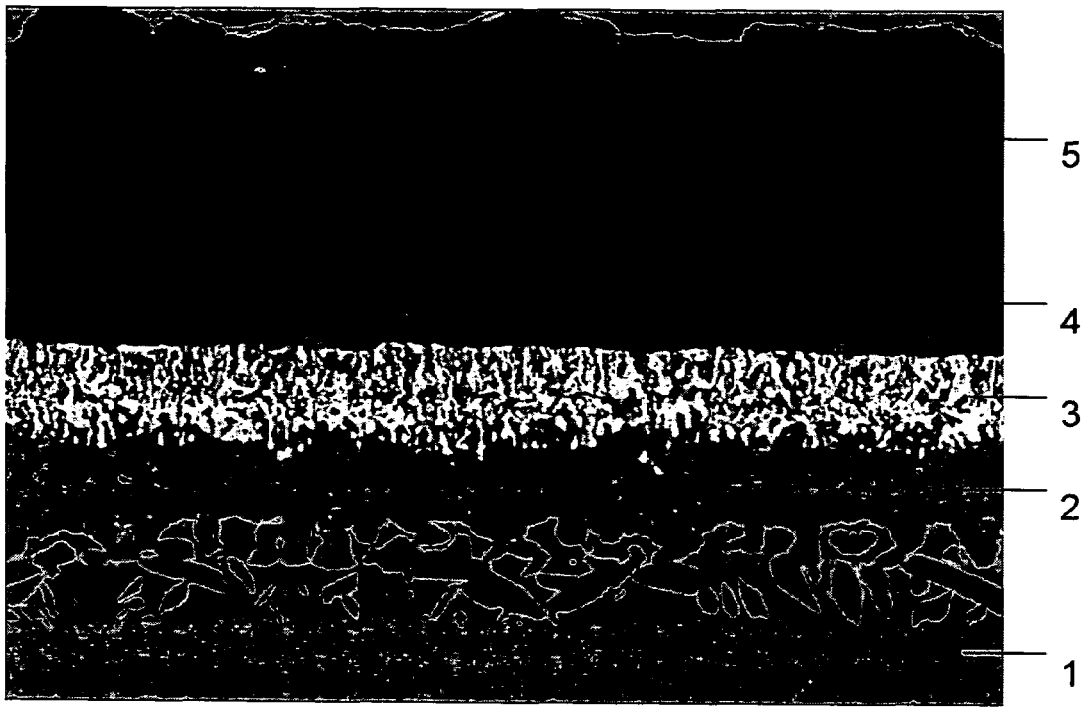
FIG. 1 shows a metallographic section through a part.

The features and advantages of the invention are explained in more detail in the description below, with reference to the only FIGURE, which shows a metallographic section through a part according to the invention.

The invention favours the technique of electrolytic deposition, since it offers the advantage of being easily included in an existing sequence of processing. Other depositing techniques, such as for example deposition by sputtering, are also within the scope of the invention. Unfortunately, it is impossible to deposit pure tungsten by electrolytic means in an aqueous medium. Further, after examining all the deposition techniques, only co-deposition of tungsten-cobalt seems to be suitable. In fact, such deposition, well-known to the person skilled in the art and described in the work of A Brenner (Electrodeposition of alloys, principle and practice, Academic Press, 1963) may contain up to 65% by mass tungsten (Codeposition of cobalt and tungsten from an aqueous ammoniacal citrate bath, D L Roy, P L Annamalai, H V K Udupa and B B Dey, Electrodeposition and metal finishing, Indian Sect. Electrochem. Soc., Karaikudi, 1957 pp 42-51, 1957), contrary to the other electrodeposited alloys where the content of tungsten reaches 50% maximum. During the annealing of this deposit, the cobalt diffuses into the alloy, thus promoting the formation of islets rich in tungsten which will serve to capture the rhenium originating from the substrate. After a second deposition of nickel intended to form the β-NiAl, the part can be aluminised by any method known to the person skilled in the art, e.g. by aluminisation of the low-activity type in a tank or by vapour phase or high-activity aluminisation in a tank or by painting or even by vapour-phase chemical deposition. It is possible, in addition to the deposition of nickel, to carry out a deposition of platinum and/or palladium according to the type of coating desired (aluminide modified or otherwise). The aluminisation selected can also be doped with an element such as zirconium and/or hafnium. All these modifications are well-known to the person skilled in the art.

Advantageously, according to the invention, the surface of the part to be coated undergoes preparation before development of the deposit itself. After a possible deoxidation cycle, in the case of a foundry blank, or degreasing in the case of a machined blank, a treatment of activation and preparation for electrolytic deposition is carried out.

This preparation of the part makes it possible to avoid the problems of flaking due to the presence of residual oxides or to passivation of the alloy to be treated. Moreover, it is preferable to avoid any operation tending to subject the surface to stress (elimination of the mechanical motor).

Following these surface preparation operations, electrolytic deposition of cobalt and tungsten is carried out. The composition of this deposit, by weight, is the following:

$35\% \leqq Co \leqq 80\%$ $20 \leqq W \leqq 65\%$.

This strongly adhesive deposit, whose thickness is between 10 and 20 μm, has the object, after diffusion annealing, of creating the seeds of a diffusion barrier capable of braking the diffusion of aluminium from the coating to the substrate and of the refractory elements towards to the coating. This latter action is at the origin of the progressive diffusion barrier: it is constructed by the accretion of rhenium on the tungsten precipitates by preventing the formation of a secondary reaction zone.

A supplementary electrolytic deposition or post-deposition can be carried out, making it possible to form, over a thickness which may vary from 5 to 15 μm accordingly, a layer formed of nickel and/or platinum and/or palladium and/or nickel-palladium. This supplementary deposit is also strongly adhesive.

After this or these deposits, the parts are subjected to the aluminisation treatment mentioned above, leading to a layer of β-NiAl modified or otherwise by platinum or palladium and doped or otherwise with zirconium and/or hafnium.

In the comparative examples and the example following, the parts to be treated are composed of a superalloy known as MCNG having the following composition in percent by mass.

| | |
|---|---|
| Cr: | 4.05 |
| Al: | 6.06 |
| W: | 5.03 |
| Ta: | 5.16 |
| Re: | 4.04 |
| Ru: | 4.02 |
| Mo: | 1.01 |
| Ti: | 0.53 |
| Hf: | 0.1 |
| Si: | 0.1 |
| Ni: | making up to 100. |

Similar results have been obtained with other superalloys having a high concentration of rhenium, such as those described in FR 2 780 982 in the name of the Applicant, the alloy Rene N6 according to U.S. Pat. No. 5,482,789 and the alloy CMSX-10 according to U.S. Pat. No. 5,366,695.

The comparative examples and the examples given below demonstrate the importance of the preparation of the part and of the various deposits. In order to check the stability over time of the coatings obtained, the coated parts have been expertly examined after ageing for 500 hours and 1000 hours at 1100° C. in air.

The secondary reaction zones have been quantified in the form of a percentage representing the ratio of the sum of the perimeters of the secondary reaction zones to the total perimeter of the sample in the plane of the metallographical section.

COMPARATIVE EXAMPLE 1

The superalloy machined blank part undergoes a low-activity aluminisation treatment by vapour phase for 5 hours at 1100° C. The donor cement is an alloy of chromium with 30% by weight aluminium (CA30), the activator is ammonium bifluoride ($NH_4F$, HF). The coating obtained is the compound defined as β-NiAl in the Ni—Al phase diagram. Its thickness is about 40 μm.

An expert examination reveals that the part treated has about 25% of secondary reaction zones, substantially located in the strongly stressed zones, such as the angles of the part.

After ageing of 500 hours the rate of secondary reaction zones as defined above is 100%, i.e. a continuous secondary reaction zone is present under the coating.

After 1000 hours, the layer of the secondary reaction zone has thickened to reach in parts more than 100 μm.

This comparative example confirms the data from existing literature, in particular that a secondary reaction zone forms systematically under the coatings obtained by diffusion.

COMPARATIVE EXAMPLE 2

The machined blank part undergoes liquid sand-blasting before being subjected to the aluminisation treatment described in Comparative example 1.

On the deposited blank, expert examination shows a very high quantity of secondary reaction zones (>90%). The experiment was not taken further.

COMPARATIVE EXAMPLE 3

The surface of a blank similar to that in Comparative example 1 is prepared by degreasing for 5 to 10 minutes in the following solution:

| | | |
|---|---|---|
| Sodium hydroxide | $NaOH$ | 10 g/l |
| Sodium carbonate | $Na_2CO_3$ | 23 g/l |
| Anhydrous trisodium phosphate | $Na_3PO_4$ | 10 g/l |
| EDTA, disodic salt | $(NaO_2CCH_2)_2N(CH_2)_2N(CH_2CO_2H)_2$ | 2 ml/l |
| Temperature | | 80° C. |

Following this operation, the part was plunged without current into a nitrohydrofluoric solution ($HNO_3$ 40% and HF 10% by volume). As soon as a uniform cloud of bubbles is formed at the surface of the part, it is plunged, this time under current, in a Wood nickel bath (bath for the electrolytic deposition of nickel in a hydrochloric medium). The current density applied is 3 A/dm$^2$, the part acting as the cathode, and the duration of treatment being 3 minutes.

Then, in accordance with the teaching of U.S. Pat. No. 6,080,246, electrolytic deposition of cobalt is carried out on the part thus prepared. The following conventional solution is used:

| | | |
|---|---|---|
| Cobalt sulphate heptahydrate | $CoSO_4$, $7H_2O$ | 500 g/l |
| Sodium chloride | $NaCl$ | 17 g/l |
| Boric acid | $H_3BO_3$ | 45 g/l |
| pH | | $\leqq 5$ |
| Deposition temperature | | $25 \leqq T \leqq 45°$ C. |
| Current density | | $3.5 \leqq J \leqq 10$ A/dm$^2$ |

After 10 minutes, a deposit of 10 μm is obtained. As is well-known to the person skilled in the art, this deposit is taut and shiny.

The part thus coated then undergoes aluminisation treatment similar to that described in Comparative example 1.

The expert examination of the coated blank demonstrates the presence of 10% secondary reaction zone, mainly concentrated in the strongly stressed regions.

After ageing of 500 hours, it is noted that there is an increase in the proportion of secondary reaction zones (about 30 to 40% of the perimeter), especially by enlargement of those already existing.

Although the microstructure of the alloy rich in refractory elements seems to have resisted better than in the preceding comparative examples, the source of instability (the aluminium of the coating) has not been eliminated thereby.

These three comparative examples confirm the part of the chemical motor (aluminisation without sand-blasting) and mechanical motor (aluminisation with sand-blasting), hence the importance of reducing the initial pre-constraints of the superalloy favoured in particular by sand-blasting and of preventing the diffusion of the aluminium towards the substrate. Moreover, they confirm that a simple increase in the stability of the chemical composition of the alloy at its surface is insufficient. In the light of these comparative examples, it can be concluded that only an interdiffusion barrier between the substrate and the coating will be sufficiently effective to avoid this instability.

EXAMPLE 1

After undergoing the preparation treatment of Comparative example 3, the part is coated with a layer of cobalt and tungsten deposited concomitantly, instead of the layer of pure cobalt.

The Co—W coating is obtained from a bath having the following formulation:

| | | |
|---|---|---|
| Cobalt chloride | $CoCl_2$, $6H_2O$ | 100 g/l |
| Sodium tungstate | $Na_2WO_4$, $2H_2O$ | 100 g/l |
| Double Na K tartrate | $NaKC_4H_4O_6$, $4H_2O$ | 400 g/l |
| Ammonium chloride | $NH_4Cl$ | 50 g/l |
| pH (regulated by $NH_4OH$) | | 8.5 |
| Deposition temperature | | 70° C. |
| Current density | | $2 \leqq J \leqq 5$ A/dm$^2$ |

Instead of the double system of anodes of tungsten and cobalt used in the work of A Brenner cited above, an insoluble anode of titanium coated in platinum or composed of pure platinum is preferably used in the invention. The advantage of this is that the concentration of the different electroactive types is made by is chemical metering and is independent of the anode potentials. The content of W may reach 65% by weight (according to the concentration of tungsten and the current density used).

After 30 minutes to an hour-and-a-half, a deposit of 10 to 30 μm is obtained. The appearance of the deposit on emerging from the bath is smooth and shiny.

The deposit of Co—W is then coated with a layer of 5 to 25 μm nickel intended to form the intermetallic NiAl compound, from the following electrolytic bath:

| | | |
|---|---|---|
| Nickel sulphamate | $Ni(SO_3NH_2)_2$ | 350 g/l |
| Nickel chloride | $NiCl_2$,$6H_2O$ | 3.5 g/l |
| Boric acid | $H_3BO_3$ | 40 g/l |
| Temperature | | 45° C. |
| Current density | | 3 A/dm$^2$ |

After annealing for 2 hours at 900° C. intended on the one hand to promote the adhesion of the deposits between themselves and to the substrate, and on the other hand to precipitate the first seeds of tungsten in a cobalt matrix so as to block the diffusion of rhenium during the aluminisation operations, the part undergoes aluminisation treatment similar to that described in Comparative example 1.

Following this treatment, the part has the microstructure shown in the only FIGURE comprising a coating formed of four consecutive layers starting from the superalloy substrate 1, in particular a conventional interdiffusion layer 2, a diffusion barrier of tungsten and rhenium 3, an intermediate layer 4 where the concentration of Ni and Al increases from the diffusion barrier and a conventional nickel aluminide 5 of stoichiometric composition β-NiAl.

An expert examination shows the absence of secondary reaction zones.

After ageing of 500 then 1000 hours in air at 1100° C., the interface is stable. The layer of oxide is dense and regular, the coating of β-NiAl has become discontinuous, the phase of $\gamma'Ni_3Al$ having formed at the grain boundaries. This phenomenon is due to the consumption of aluminium by the thermally formed layer of aluminium. Finally, the layer of W—Re is enriched with rhenium, this element being now in the majority. This layer thus acts as a diffusion barrier formed in situ. No secondary reaction zone is observed.

The example was repeated by varying the content of tungsten in the Co—W deposit between 35 and 65% by weight, its thickness between 5 and 25 μm, and the thickness of the complementary nickel deposit between 5 and 25 μm. In all cases, expert examination showed the absence of secondary reaction zones, except for one or two in very strongly stressed regions (test piece corners and/or close to porous areas in the substrate).

After the longest ageing tests (1000 hours), the samples are healthy: the layer of oxide is of normal thickness for isothermic oxidation (6 μm on average), there has been no diffusion of the aluminium of the coating to the substrate and the consumption of this element is only due to oxidation which brings about the appearance of the phase $\gamma'$-$Ni_3Al$ along the grain boundaries of the coating. The most remarkable element of this series of tests is the absence of secondary reaction zones: this microstructure was not observed either before or after ageing. The result is that the mechanical properties of the alloy are preserved and the service life of the coating is increased since the aluminium it contains is reserved for the phenomena of oxidation at high temperature.

EXAMPLE 2

On the surface of a sample of the alloy MCNG, an alloy of cobalt and tungsten was deposited by triode cathode sputtering. To this end two targets were selected: one composed of pure cobalt and the other of pure tungsten. Finally, the deposit obtained was about 20 μm thick and was a mixture of cobalt and tungsten with a variable tungsten content of about 50% by weight. In order to check the effectiveness of this coating, only one face was coated.

Following this operation, the sample was annealed in a furnace in a vacuum better than $10^{-3}$ Pa at a temperature of 900° C. for two hours in order to promote the adhesion of the deposit to the substrate and to germinate the first precipitates of tungsten. Following this operation, a deposit of pure nickel of about 20 to 30 μm can be applied, which can be carried out either electrolytically or by triode cathode sputtering. After renewed annealing for 2 h in a vacuum at 900° C., the sample is aluminised as is described in Comparative example 1. Following this treatment, the part has on the treated face a microstructure in four layers comparable to that shown in the only FIGURE, whereas the untreated face shows a secondary reaction zone which is virtually continuous and has a depth of about 10 to 15 μm.

After an ageing treatment of 500 hours at 1100° C., the treated face still has no progressive secondary reaction zones, whereas those present on the untreated face now have a depth of about 50 μm.

EXAMPLE 3

On the surface of a sample of the alloy MCNG, an alloy of cobalt and tungsten was deposited by triode cathode sputtering. To this end two targets were selected: one composed of pure cobalt and the other of pure tungsten. Finally, the deposit obtained was about 20 μm thick and was a mixture of cobalt and tungsten with a variable tungsten content of about 50% by weight. In order to check the effectiveness of this coating, only one face was coated.

Following this operation, the sample was annealed in a furnace in a vacuum better than $10^{-3}$ Pa at a temperature of 1050° C. for five hours in order to promote the adhesion of the deposit to the substrate and to germinate the first precipitates of tungsten and to bring about the first co-precipitations of rhenium on the tungsten seeds in the Co—W deposit. Following this operation, a deposit of pure nickel of about 20 to 30 μm was applied by triode cathode sputtering and then an electrolytic deposition of platinum whose thickness is between 5 and 7 μm. After renewed annealing of 1 h in a vacuum at 1100° C. (conventional annealing carried out in the case of aluminides modified by platinum), the sample was aluminised as is described in Comparative example 1, except that the cement is of very low activity (alloy of chromium at 20% by mass with aluminium known as CA20) and the deposition atmosphere is composed of argon.

At the end of these aluminisation operations, the sample undergoes a final annealing in a vacuum better than $10^{-3}$ Pa for 1 h at 1100° C. with the aim of obtaining a coating of nickel aluminide modified by the strictly monophase platinum.

Following this treatment, the part has a microstructure in four layers reminiscent of that shown in the only FIGURE. However, it should be noted that a negative gradient of concentration of platinum (from the edge of the coating towards the substrate) exists in zone 5 of the only FIGURE. It is also noted that the thickness of the diffusion barrier (zone 3 of the only FIGURE) is then denser, a fact explicable by the duration of the annealing of the CoW deposit. On the treated side, no secondary reaction zone was visible, whereas on the other face 100% of the interdiffusion zone surmounts a secondary reaction zone of about 20 μm thick. This difference is even more visible after ageing of 500 hours at 1100° C.: on the treated face, the aluminide is still substantially formed of the beta phase (NiPt)Al without subjacent secondary reaction zone, whereas on the other face the nickel aluminide is substantially formed of gamma apostrophe $Ni_3Al$ surmounting a secondary reaction zone of more than 100 μm thickness.

The examples 2 and 3 above show that the cobalt and tungsten alloy can be deposited by other techniques than electrolysis and in particular by sputtering.

As is indicated above, the invention is applicable in the case of nickel aluminide coatings modified by platinum and/or palladium and/or doped with zirconium and/or hafnium. By way of illustration, the procedure given below can be carried out on a foundry blank such as a blade of a turboengine, embarked or otherwise:

deoxidation in alkaline solution with a high content of soda (such as that sold by the firm TURCO under the commercial name TURCO 4008-3) for one hour at 110° C.

activation of the surface in a solution of hydrochloric acid at 20% ([HCl]≈2 M) for the time necessary to obtain homogeneous activity at the surface of the part to be treated (between 30 seconds and 3 minutes), electrolytic deposition of nickel in a hydrochloric acid bath (Wood nickel) for 3 minutes to reach a thickness of about 0.1 to 0.2 μm, electrolytic deposition of Co—W in a bath such as that described in the example, having a tungsten content of between 35 and 65% by weight and a thickness of between 5 and 25 μm, electrolytic deposition of pure nickel in a conventional nickel bath, having a thickness of 5 to 25 μm, electrolytic deposition of platinum in a conventional solution (e.g. the bath sold by the firm Englehard—CLAL under the reference Pt 209), of a thickness between 5 and 15 μm, and/or electrolytic deposition of palladium-nickel in a conventional solution (e.g. the bath sold by the firm Englehard—CLAL under the reference "palladium nickel spécial aéro"), following the whole of these electrolytic depositions, interdiffusion annealing without any reactive atmosphere (vacuum, argon etc.) for a duration of between one and five hours at a temperature of between 850 and 1050° C.

The part thus treated is then placed in an enclosure to receive aluminisation. This can be carried out for 2 to 16 hours in hydrogen and/or in argon at a temperature of between 700 and 1150° C., these two parameters (time and temperature) being selectable according to the alloy being treated, as is well-known to the person skilled in the art. According to the donor cement of aluminium, this aluminisation will be high- or low-activity. This aluminisation can also be doped with zirconium or hafnium as is described in FR 2 853 329.

At the end of this treatment, the superalloy with a base rich in refractory elements, in particular rhenium and/or ruthenium, is coated with a nickel aluminide modified or otherwise with platinum and/or palladium and doped or otherwise with zirconium and/or hafnium, having a diffusion barrier rich in tungsten, rhenium/ruthenium and chromium, formed in situ on seeds of pure tungsten. The service life of such a coating is related to that of the alloy itself.

What is claimed is:

1. Method of protecting against corrosion of a surface of a monocrystalline superalloy containing at least one refractory metal comprising:

depositing a layer formed of tungsten and cobalt on the surface of the monocrystalline superalloy; and depositing an aluminium coating on the tungsten and cobalt layer.

2. Method according to claim 1, wherein the superalloy includes a base selected from the group consisting of nickel, cobalt, iron, and combinations thereof.

3. Method according to claim 1, wherein the superalloy contains at least one refractory metal selected from the group consisting of rhenium and ruthenium.

4. Method according to claim 1, wherein the superalloy comprises a matrix of a phase γ in which hardening particles of a phase γ' are dispersed, and at least one refractory metal is contained in the phase γ at a concentration close to its solubility limit.

5. Method according to claim 1, wherein tungsten and cobalt are deposited concomitantly by electrolytic means to form the tungsten and cobalt layer.

6. Method according to claim 5, wherein the layer contains about 35 to 80% by mass cobalt and 65 to 20% by mass tungsten.

7. Method according to claim 1, wherein the thickness of the tungsten and cobalt layer is between about 5 and 25 μm.

8. Method according to claim 7, wherein the thickness of the tungsten and cobalt layer is between about 10 and 20 μm.

9. Method according to claim 1, wherein the aluminium coating is formed by aluminisation treatment.

10. Method according to claim 9, wherein the aluminium coating further contains at least one element selected from the group consisting of zirconium and hafnium.

11. Method according to claim 9, wherein, before the aluminisation treatment, an intermediate layer containing at least one element selected from the group consisting of platinum and palladium is deposited on the tungsten and cobalt layer.

12. Method according to claim 11, wherein the intermediate layer has a thickness of between about 5 and 15 μm.

13. Method according to claim 1, wherein an electrolytic pre-deposition of nickel to form a nickel layer is carried out before forming the tungsten and cobalt layer.

14. Method according to claim 13, wherein the nickel layer has a thickness of between about 0.1 and 0.2 μm.

15. Method according to claim 1, further comprising the formation of a nickel layer by electrolytic post-deposition of nickel after forming the tungsten and cobalt layer and before the deposition of aluminium.

16. Method according to claim 15, wherein the nickel layer has a thickness of between about 5 and 25 μm.

17. Method according to claim 16, wherein the thickness of the nickel layer is between about 5 and 15 μm.

18. Method according to claim 1, further comprising annealing the tungsten and cobalt layer.

19. Method of claim 1, wherein the tungsten and cobalt layer consists essentially of tungsten and cobalt.

* * * * *